US006336977B1

(12) United States Patent
Menke et al.

(10) Patent No.: US 6,336,977 B1
(45) Date of Patent: Jan. 8, 2002

(54) GELLED CLEANING AGENT FOR FLUSH TOILETS

(75) Inventors: Ronald Menke, Mettmann; Alexander Ditze; Frank Pessel, both of Duesseldorf, all of (DE)

(73) Assignee: Henkel Kommanditgesellschaft Auf Aktien (KGaA), Duesseldorf (DE)

( * ) Notice: Subject to any disclaimer, the term of this patent is extended or adjusted under 35 U.S.C. 154(b) by 0 days.

(21) Appl. No.: 09/403,150

(22) PCT Filed: Apr. 11, 1998

(86) PCT No.: PCT/EP98/02123

§ 371 Date: Jan. 10, 2000

§ 102(e) Date: Jan. 10, 2000

(87) PCT Pub. No.: WO98/46712

PCT Pub. Date: Oct. 22, 1998

(51) Int. Cl.[7] ..... C11D 1/66; C11D 11/00; C11D 13/10

(52) U.S. Cl. ..... 134/42; 510/191; 510/192; 510/193; 510/403; 510/470; 134/39

(58) Field of Search ..... 510/191, 192, 510/193, 403, 470; 134/39, 42

(56) References Cited

U.S. PATENT DOCUMENTS 5,047,167 A 9/1991 Steyn et al. ..... 252/160

FOREIGN PATENT DOCUMENTS

| | | | |
|---|---|---|---|
| DE | 195 201 45 | | 12/1996 |
| EP | 0 323 209 | | 7/1989 |
| GB | 2 288 186 | | 10/1995 |
| GB | 2288186 A | * | 10/1995 |
| WO | WO90/12082 | | 10/1990 |
| WO | WO92/06161 | | 4/1992 |

* cited by examiner

*Primary Examiner*—Mark Kopec
*Assistant Examiner*—Brian P. Mruk
(74) *Attorney, Agent, or Firm*—W. C. Jaeschke; Glenn E.J. Murphy

(57) ABSTRACT

A stable, gel-form, shear-thinning cleaning composition is presented containing (a) 1 to 5 percent by weight of a polysaccharide, (b) 3 to 25 percent by weight of a $C_{8-22}$ alkyl polyglycoside, and (c) 2 to 15 percent by weight of a perfume. The composition has a viscosity of 30,000 to 150,000 mPas as measured with a Brookfield RVT rotational viscometer with a Helipath spindle and TA spindle at 1 r.p.m. at 23° C. The composition is a visually attractive, translucent or clear pseudoplastic gel and useful in the cleaning flush toilets.

37 Claims, No Drawings

GELLED CLEANING AGENT FOR FLUSH TOILETS

This application is filed under 35 U.S.C. 371 and based on PCT/EP98/02123, filed Apr. 11, 1998.

BACKGROUND OF THE INVENTION

1. Field of the Invention

This invention relates to a gel-form cleaner which may be used with advantage in flush toilets.

2. Discussion of Related Art

It is known that solid cleaning compositions in block form are used for automatically keeping toilets clean. These cleaning blocks are arranged either in the lavatory bowl or in the cistern. Water flows over the blocks each time the toilet is flushed so that the blocks gradually dissolve and, in doing so, release their cleaning ingredients. Normally, the cleaning blocks also contain fragrance to perfume the surrounding environment or disinfecting agents to optimize hygiene. The described cleaning blocks are applied in suitable containers, in some cases in special refillable containers.

The described cleaning blocks are generally produced by casting, compression, extrusion or granulation processes which involve a high outlay on equipment and which often suffer unwanted losses of perfume through the high temperatures involved (casting/extrusion processes).

Another disadvantage is that the refill units, which are widely used for ecological reasons, can only be employed after the cleaning block has been used up. Selective refilling which would be desirable, for example, to intensify the release of active ingredients or, more particularly, to release more perfume is not possible.

The problem addressed by the present invention was to provide a system which would not have any of the disadvantages described above. It has now surprisingly been found that special gel-form preparations with pseudoplastic properties significantly reduce the outlay on production equipment and can be produced less expensively by a simple process. The problem of individual refillability can also be solved by the pseudoplastic active-substance preparations according to the invention. A special container, which is particularly suitable for the gel-form cleaning compositions according to the invention, is described in DE-A-195 201 45.

DESCRIPTION OF THE INVENTION

The present invention relates to a stable, gel-form and shear-thinning cleaning composition which, in addition to a polysaccharide, contains a $C_{8-22}$ alkyl polyglycoside as its surfactant system and perfume components, the composition containing a polysaccharide in quantities of 1 to 5% by weight as one component of the surfactant system, a $C_{8-22}$ alkyl polyglucoside in quantities of 3 to 25% by weight, the perfume component(s) in quantities of 2 to 15% by weight and optionally other ingredients, such as co-surfactants, lime-dissolving agents, dyes, germ inhibitors, pearlescers, stabilizers, cleaning boosters and odor absorbers and having a viscosity in the range from 30,000 to 150,000 mPas (as measured with a Brookfield RVT rotational viscosimeter with a Helipath spindle and TA spindle at 1 r.p.m./23° C.).

It has been found that visually attractive, translucent or clear pseudoplastic gel structures, which are as stable as solid rim blocks in suitable containers, can only be obtained with polysaccharides in the described combinations, depending on the types selected with high perfume and APG concentrations.

Other standard gel formers such as, for example, polyacrylic acid (Carbopol), surfactant-thickened systems, MHPC (Natrosol) or sodium- chloride- or electrolyte-thickened surfactant systems do not show adequate gel stability where the high surfactant and perfume levels required are used. These formulations are often not sufficiently pseudoplastic, are diluted by water flowing over them and, on account of their inadequate viscosity behavior, drip uncontrollably into the lavatory bowl despite suitable containers. By contrast, the formulations according to the invention are decidedly pseudoplastic and withstand the water flowing over them to the extent that only small amounts are released and the required stability is obtained. This is because the compositions should also not dissolve too readily in the water penetrating into their containers, otherwise they would be dissolved and therefore exhausted after only a small number of flushes.

In addition, it is important to ensure that, despite the high concentrations of perfume and emulsifier, the gels are guaranteed adequate long-term stability and, for example, do not separate into phases which would not only diminish their visual appeal to the consumer, it would also impair dissolving kinetics and dose control.

Another advantage is that the viscosity of the compositions decreases with increasing shear rate so that they can be packed in containers during the production process and are easy to handle by the consumer during dosing/refilling.

Surprisingly, it has also been found that, under certain conditions in the production process, air bubbles can be introduced into the compositions according to the invention and retain their shape and size over a period of several weeks so that the end product becomes even more attractive to the consumer.

The size of the air bubbles, which can be controlled for example through the stirring rate in the production process and through the viscosity of the compositions, should be neither too large nor too small. In addition, the quantity of air bubbles should only be selected in a preferred range. If, therefore, the presence of air bubbles should be desirable, no more than 30% volume of air should be present, air volumes of 2 to 25% by volume being preferred and air volumes of 5 to 20% by volume being particularly preferred. Particularly preferred embodiments contain air bubbles between 0.1 mm and 20 mm in diameter, air bubbles between 1 mm and 15 mm diameter being most particularly preferred.

However, the viscosity of the compositions according to the invention also enables the air bubbles already introduced in the production process to be removed by brief application of a reduced pressure which may be in a range just below ambient pressure to approaching a vacuum. The duration of the reduced pressure treatment will depend on the strength of the reduced pressure. If a relatively strong reduced pressure is applied, the treatment need not be continued for very long. However, the expert also knows that an excessive reduced pressure can result in unwanted side effects including, for example, the intensified evaporation of readily volatile perfume components and, in some cases, problems affecting the stirrability of the system. Although the compositions according to the invention can be degassed by treatment in a centrifuge or by ultrarapid stirring, such treatments are not preferred.

This is because, if possible, the compositions according to the invention should not be exposed to excessive shear forces during or after the production process because otherwise the properties according to the invention would often be lost in the short to medium term and could only be recovered after long waiting times.

The formulations according to the invention may be produced in various ways and in various batch sizes up to, and including, several tonnes.

Normally, water is introduced into a commercially available mixer, for example a Beco-Mix, and the dye is stirred in. The xanthan gum preferably used as the polysaccharide is separately suspended with solvent, preferably ethanol, and the required perfume oil. The suspension is then added and the whole is stirred at low speed, for example at 30 r.p.m.

Investigations have shown that, after all the components have been added, a time of a few minutes to a few hours is required to reach the consistency according to the invention. In the present case, the surfactant (alkyl polyglycoside) was slowly added after 30 minutes. The other components are then added. If a bubble-free gel is to be guaranteed, the mixture has to be placed under a reduced pressure or under a vacuum, as described above, in a suitable container in dependence upon its viscosity, but generally for a short time, for example 15 minutes.

However, other procedures may be adopted. This is advisable, for example, where disinfectants are to be included. In this case, water is normally introduced into a commercially available mixer, for example a Beco-Mix, and the xanthan gum used is then stirred in. The suspension is then added and the whole is stirred at low speed, for example at 30 r.p.m., before the surfactant mixture (alkyl polyglycol/fatty alcohol ether sulfate) is slowly added after 30 minutes. The dye is then added before a solution of the perfume in ethanol is introduced. The disinfectant, preferably selected from the group of isothiazolines, benzoates or salicylic acid or salicylates, is added next. In this case, the composition can be packed in commercially available measuring bottles, for example in a rotary bottle filling machine.

Particular care has to be taken when substances are added to the prepared and swollen water-containing xanthan gel to allow the structure according to the invention to form. If these substances are added too quickly, phase separation problems can arise. In addition, no surfactant should be present during the preparation of the xanthan gel component because it would prevent gel formation. Accordingly, it is very much preferred to add the surfactant components after formation of the gel.

Viscosity may be measured by any of the methods normally used. Brookfield viscosimeters which have a spindle specially designed for gels were used in the present case. The viscosities according to the invention were measured with this Helipath spindle.

In one basic formulation, the compositions according to the invention may contain the following components:

1.0–5.0% by weight of polysaccharide 3.0–25.0% by weight of $C_{8-22}$ alkyl polyglycoside 0–15.0% by weight of co-surfactants (FAS, FAEOS)

0–5.0% by weight of citric acid

0–5.0% by weight of complexing agent 2 to 15% by weight, preferably 2 to 12% by weight and more preferably 3 to 8% by weight of perfume up to 5.0% by weight and preferably from 0.01 to 4% by weight of solvent, for example ethanol 0–1.0% by weight of preservative 0–10.0% by weight of dye 0–5.0% by weight and preferably 0.01 to 3% by weight of germ inhibitor.

In the context of the present invention, a polysaccharide is understood, for example, to be a xanthan gum or a guar gum or a mixture of polysaccharides. Xanthan is formed from a chain with β-1,4-linked glucose (cellulose) with side chains. The structure of the sub-groups consists of glucose, mannose, glucuronic acid, acetate and pyruvate. Xanthan is produced by Xanthonomas campestris under aerobic conditions with a molecular weight of $2–15\times10^6$. Xanthan is produced inter alia in bath cultures and, after destruction of the culture and precipitation with propanol, is dried and ground. Other suitable methods are also described in the literature. The polysaccharide, particularly xanthan gum, is present in the compositions in quantities of 1 to 4% by weight, preferably 1.5 to 3.5% by weight and more preferably 1.8 to 3% by weight.

Alkyl polyglycosides are surfactants which may be obtained by reacting sugars and alcohols using the relevant methods of preparative organic chemistry. A mixture of monoalkylated, oligomeric or polymeric sugars is obtained according to the particular method of production used. Preferred alkyl polyglycosides are alkyl polyglucosides. In a particularly preferred embodiment, the alcohol is a long-chain fatty alcohol with alkyl chain lengths of $C_8$ to $C_{22}$, preferably from $C_8$ to $C_{16}$ and more preferably from $C_8$ to $C_{12}$ or a mixture of long-chain fatty alcohols. The degree of oligomerization of the sugars which is a calculated quantity, i.e. is generally not a whole number, is between 1 and 10, preferably between 1.1 and 5, more preferably between 1.2 and 3 and most preferably between 1.3 and 2.5. The compositions contain $C_{8-22}$ alkyl polyglycosides in quantities of preferably 4 to 20% by weight, more preferably 5 to 17% by weight and most preferably 5 to 15% by weight. Quantities of up to 12% by weight can also be of advantage.

According to the invention, anionic co-surfactants include aliphatic sulfates, such as fatty alcohol sulfates, fatty alcohol ether sulfates, dialkyl ether sulfates, monoglyceride sulfates, and aliphatic sulfonates, such as alkane sulfonates, olefin sulfonates, ether sulfonates, n-alkyl ether sulfonates, ester sulfonates and lignin sulfonates. Other anionic cosurfactants which may be used in accordance with the invention, but are not preferred, include fatty acid cyanamides, sulfosuccinic acid esters, fatty acid isethionates, acylaminoalkane sulfonates (fatty acid taurides), fatty acid sarcosinates, ether carboxylic acids and alkyl (ether)phosphates. Fatty alcohol sulfates and fatty alcohol ether sulfates are preferably used. Hitherto, less favorable results were obtained with alkyl benzenesulfonates.

In one preferred embodiment of the invention, the ratio by weight of alkyl polyglycoside to co-surfactants, more particularly to fatty alcohol ether sulfates and/or fatty alcohol sulfate, is at least 1:1, ratios of 50:1 to 1:1, preferably from 10:1 to 1.5:1 and more preferably from 5:1 to 1.8:1 being particularly advantageous.

However, nonionic co-surfactants may also be used. Nonionic surfactants in the context of the present invention include alkoxylated alcohols, such as polyglycol ethers, fatty alcohol polyglycol ethers, alkylphenol polyglycol ethers, end-capped polyglycol ethers, mixed ethers and hydroxy mixed ethers and fatty acid polyglycol esters. Ethylene oxide, propylene oxide, block polymers and fatty acid alkanolamides and fatty acid polyglycol ethers may also be used.

Alkoxylated alcohols are generally understood to be the reaction products of alkylene oxide, preferably ethylene oxide, with alcohols. Relatively long-chain alcohols are preferred for the purposes of the present invention. Depending on the reaction conditions, a complex mixture of addition products with different degrees of ethoxylation is generally formed from n mol of ethylene oxide and 1 mol of alcohol. Another embodiment is characterized by the use of mixtures of alkylene oxides, preferably a mixture of ethylene oxide and propylene oxide. If desired, "capped" alcohol ethoxylates, which may also be used for the purposes of the invention, can also be obtained by etherification with short-chain alkyl groups, preferably butyl groups, in a concluding step. According to the invention, highly ethoxylated fatty alcohols or mixtures thereof with end-capped fatty alcohol ethoxylates are most particularly preferred.

The described formulations may advantageously contain inorganic or organic acids, such as citric acid, acetic acid, lactic acid or water-soluble salts thereof, in a quantity of 1 to 12% by weight as the lime-dissolving agent. Contents of 2 to 5% by weight are particularly preferred.

The compositions according to the invention preferably contain dye either for coloring the product or for coloring the liquid circulating around the container. In a preferred embodiment, the content of water-soluble dyes is below 1% by weight and is intended to improve the appearance of the product. If an additional color signal is required during flushing, the content of water-soluble dyes may be increased to 5% by weight. The content of water-soluble dye is preferably up to 3% by weight, more preferably up to 2% by weight and most preferably up to 1% by weight.

Although the gels according to the invention already have an excellent cleaning effect without this component, the hygienic effect can be enhanced by the addition of germ inhibitors. The quantity of germ inhibitor used is governed to a large extent by the effectiveness of the particular compound and may be as much as 5% by weight. A quantity of at least 0.01% by weight is preferably incorporated in the gels, quantities of 0.01% by weight to 3% by weight being particularly preferred. Isothiazoline mixtures, sodium benzoate or salicylic acid and salicylates are particularly suitable. Other preferred quantities are from 0.01 to 2% by weight and more preferably from 0.01 to 1% by weight.

Suitable solubilizers, for example for dyes and perfume oils, include for example alkanolamines, polyols, such as ethylene glycol, representatives of the lower alcohols, such as propylene glycol, glycerol and other monohydric and polyhydric alcohols and also alkyl benzenesulfonates with 1 to 3 carbon atoms in the alkyl moiety. The group of lower alcohols is particularly preferred, ethanol being most particularly preferred. Preferred quantities are up to 5% by weight, more particularly between 0.01 and 4% by weight, advantageously between 0.1 and 4% by weight and, in a most particularly preferred embodiment, between 0.5 and 3% by weight.

Conventional thickeners, which could be used if required, include urea, sodium chloride, sodium sulfate, magnesium sulfate, ammonium chloride and magnesium chloride and combinations thereof. However, the use of these additional thickeners is not preferred.

The cleaning compositions according to the invention may optionally contain water-soluble and water-insoluble builders. Water-soluble builders are preferred because they are generally not as prone to form insoluble residues on hard surfaces. Conventional builders or complexing agents which may be present in accordance with the invention include low molecular weight polycarboxylic acids and salts thereof, homopolymeric and copolymeric polycarboxylic acids and salts thereof, citric acid and salts thereof, carbonates, phosphates and silicates. Water-insoluble builders include zeolites, which may also be used, and mixtures of the builders mentioned above. The group of citrates is particularly preferred. The compositions according to the invention contain builders or complexing agents in quantities of up 10% by weight, preferably from 0.1 to 8% by weight, more preferably from 1 to 6% by weight and most preferably from 2 to 5% by weight.

EXAMPLES

The following Examples are intended to illustrate some of the preferred compositions according to the invention. Their performance was evaluated by the following methods.

Viscosity

In the Examples, viscosity was measured with A Brookfield Roto Viscosimeter (RVT rotational viscosimeter) with a Helipath spindle and TA spindle at 1 r.p.m./23° C.

Wagner Foam Behavior Test

In a 1,000 ml measuring cylinder, 0.1 g of gel are foamed in 500 ml of tap water (hardness 17° d) by 40 strokes at a rotational speed of 100 r.p.m. The foam volume is read off after 1, 3 and 10 minutes.

Flushing Behavior

This was measured in an automatically controlled lavatory which releases the contents of the cistern at intervals of 1 hour and refills the cistem with 9 liters of tap water having a hardness of 17° d and a temperature of 15 to 16° C. One filling of a container according to DE 195 201 45 is suspended in the toilet and the number of flushes required to exhaust the filling is counted. The average results are determined from 5 parallel tests.

Determination of Lime Dissolving Capacity

Preweighed white Carrara marble tiles measuring 74×150×5 mm are completely immersed in the gel in a Plexiglas bowl. The immersion time is 10 seconds. The tile is then removed and placed vertically in a stand. This has to be done in such a way that any adhering product can drain off. The contact time of the adhering product is another 10 minutes. The tile is then rinsed with water and the weight loss is determined after drying at 105° C.

pH Value

The pH value was measured electrochemically in the concentrate.

Storage Stability

The gels were stored in electrically controlled heating cabinets. The storage times at 40° C. were 3 weeks and 4 weeks and, at 23° C., 12 weeks. The stored product was then visually evaluated.

EXAMPLE 1

Lime-dissolving Cleaning Gel Based on a Nonionic Surfactant System

| Quantities in | % by weight |
|---|---|
| Xanthan gum, granulated, for example Keltrol ® RD | 2.3 |
| $C_{8-10}$ alkyl polyglycoside | 16.0 |
| Perfume oils, lemon note | 5.0 |
| Citric acid | 3.0 |
| Ethanol | 3.0 |
| Dye, water-soluble | <0.01 |
| Water | to 100 |
| Viscosity: 70,000–75,000 mPas | |
| pH value: 2.6 | |
| Gel structure/appearance: | transparent gel |
| Filling: | 40 g |
| Flushing behavior: | 220 flushes at 21 per day |

-continued

| Quantities in | % by weight |
|---|---|
| Foam behavior: | 300 ml after 1 min.; 300 ml after 3 mins.; 250 ml after 10 mins. |
| Lime dissolving capacity: | 193 mg calcium carbonate |
| Storage stability: | no phase separation after 4 weeks at 40° C. no phase separation after 12 weeks at 23° C. |

Production Variant 1:

Production may be carried out in various batch sizes up to, and including, several tonnes.

Normally, water is introduced into a commercially available mixer, for example a Beco-Mix, and the dye is stirred in. The xanthan gum used is separately suspended with solvent, preferably ethanol, and the required perfume oil. The suspension is then added and the whole is stirred at low speed, for example at 30 r.p.m.

Investigations have shown that, after all the components have been added, a time of a few minutes to a few hours is required to reach the consistency according to the invention. In the present case, the surfactant (alkyl polyglycoside) was slowly added after 30 minutes. The citric acid is then added.

If a bubble-free gel is to be guaranteed, the mixture has to be placed under a reduced pressure or under a vacuum in a suitable container in dependence upon its viscosity, but generally for a short time, for example 15 minutes.

Packing in suitable storage containers can be carried out, for example, using a suitable commercially available tube filling machine.

EXAMPLE 2

Lime-dissolving Cleaning Gel with Disinfectant

| Quantities in | % by weight |
|---|---|
| Xanthan gum | 2.70 |
| $C_{8-10}$ alkyl polyglucoside | 5.44 |
| Perfume oil, apple note | 6.00 |
| Citric acid 1 $H_2O$ | 3.30 |
| Ethanol | 3.00 |
| Semiacetal/isothiazoline combination | 0.15 |
| Dye blue/dye yellow | <0.01 |
| Water | to 100 |
| viscosity: | 65,000–70,000 mPas |
| pH value: | 2.6 |
| Gel structure/appearance: | transparent gel |
| Filling: | 50 g |
| Flushing behavior: | 250 flushes at 21 per day |
| Foam behavior: | 310 ml after 1 min.; 300 ml after 3 mins.; 270 ml after 10 mins |
| Lime dissolving capacity: | 190 mg calcium carbonate |
| Storage stability: | air bubbles stable in the gel after 4 weeks at 40° C. no phase separation after 12 weeks at 23° C. |

Production Variant 2:

In this case, too, production can be carried out in various batch sizes up to several tonnes. Water is normally introduced into a commercially available mixer, for example a Beco-Mix, and the xanthan gum used is then stirred in. The suspension is then added and the whole is stirred at low speed, for example at 30 r.p.m., before the surfactant (or surfactant mixture, see following examples) was slowly added after 30 minutes. The dye was then added before a solution of the perfume in ethanol is introduced. The disinfectant was added next.

In this case, the composition can be packed in a commercially available measuring bottle, for example in a rotary bottle filling machine.

EXAMPLE 3

Cleaning Gel Containing Complexing Agent and Disinfectant

| Quantities in | % by weight |
|---|---|
| Polysaccharide (Keltrol RD) | 2.9 |
| $C_{8-10}$ alkyl polyglucoside | 5.4 |
| $C_{12-14}$ fatty alkyl ether sulfate + 2EO | 8.1 |
| Trisodium citrate | 5.0 |
| Perfume oil Missouri (Lucta) 91025 P | 6.0 |
| Ethanol | 3.0 |
| Salicylic acid | 0.3 |
| Dye, water-soluble, blue/yellow | <0.01 |
| Water | to 100 |
| Viscosity: | 70,000 mPas |
| pH value: | 10.0 |
| Gel structure/appearance: | transparent gel |
| Filling: | 40 g |
| Flushing behavior: | 230 flushes at 21 per day |
| Storage stability: | no phase separation after 4 weeks at 40° C. or 12 weeks at 23° C. |

Production as in Example 1

EXAMPLE 4

Perfume-enhanced Cleaning Gel

| Quantities in | % by weight |
|---|---|
| Polysaccharide (Keltrol RD) | 2.5 |
| $C_{8-10}$ alkyl polyglucoside | 12.0 |
| $C_{12-14}$ alkyl polyglucoside | 2.5 |
| $C_{12-14}$ fatty alkyl ether sulfate + 2EO | 2.8 |
| Citric acid | 3.0 |
| Perfume oil, apple note (TTF) 88-3813 | 10.0 |
| Ethanol | 3.0 |
| Dye, water-soluble, blue | <0.01% |
| Water | to 100 |
| Viscosity: | 87,000 mPas |
| pH value: | 3.5 |
| Gel structure/appearance: | cloudy gel with air bubbles |
| Storage stability: | no phase separation after 4 weeks at 40° C. or 12 weeks at 23° C. |

Production: as in Examples 1 and 2.

EXAMPLE 5

Highly Perfumed Cleaning Gel with Maximum Perfume Content

| Quantities in | % by weight |
|---|---|
| Polysaccharide (Keltrol T) | 2.6 |
| $C_{8-10}$ alkyl polyglucoside | 16.0 |
| $C_{12-14}$ ether sulfate + 2EO | 2.8 |
| Citric acid | 3.0 |

-continued

| Quantities in | % by weight |
|---|---|
| Perfume oil, apple note (TTF) 88-3813 | 15.0 |
| Ethanol | 6.0 |
| Semiacetal/isothiazoline combination | 0.15 |
| Dye, water-soluble, blue/yellow | <0.01% |
| Water | to 100 |
| Viscosity: | 95,000 mPas |
| pH value: | 3.6 |
| Gel structure/appearance: | cloudy gel with creamy character |
| Filling: | 35 g |
| Flushing behavior: | 300 flushes at 21 per day |
| Foam behavior: | 100 ml after 1 min.; 80 ml after 3 mins.; 50 ml after 10 mins. |
| Storage stability: | no phase separation after 4 weeks at 40° C. or 12 weeks at 23° C. |

Production: as in Example 1.

The incorporation of high perfume contents may require smaller dosing steps to guarantee phase stability.

EXAMPLE 6

High-viscosity Cleaning Gel with Increased Stability

| Quantities in | % by weight |
|---|---|
| Polysaccharide (Keltrol RD) | 4.5 |
| $C_{8-10}$ alkyl polyglucoside | 16.0 |
| $C_{12-14}$ ether sulfate + 2EO | 2.9 |
| Citric acid | 3.5 |
| Perfume oil, apple note (TTF) 88-3813 | 6.0 |
| Ethanol | 3.5 |
| Salicylic acid | 0.2 |
| Dye, water-soluble, blue/yellow | <0.01 |
| Water | to 100 |
| Viscosity: | 148,000 mPas |
| pH value: | 3.6 |
| Gel structure/appearance: | fresh, slightly cloudy gel with air bubbles |
| Filling: | 50 g |
| Flushing behavior: | 500 flushes at 21 per day |
| Foam behavior: | 290 ml after 1 min.; 290 ml after 3 mins.; 250 ml after 10 mins. |
| Storage stability: | no phase separation after 4 weeks at 40° C. or 12 weeks at 23° C. |

Production: as in Example 1

EXAMPLE 7

Viscous Cleaning Gel Containing Amphoteric Surfactant

| Quantities in | % by weight |
|---|---|
| Polysaccharide (Keltrol T) | 2.7 |
| $C_{8-10}$ alkyl polygluoside | 12.8 |
| Fatty acid amide derivative with betaine structure (Dehyton K) | 10.0 |
| Citric acid | 3.0 |
| Perfume oil, citrus note (TTF) 15-0596-A | 5.0 |
| Ethanol | 2.5 |

-continued

| Quantities in | % by weight |
|---|---|
| Semiacetal/isothiazoline combination | 0.15 |
| Dye, water-soluble yellow | <0.01 |
| Water | to 100 |
| Viscosity: | 90,000 mPas |
| pH value: | 3.5 |
| Gel structure/appearance: | transparent gel |
| Filling: | 40 g |
| Flushing behavior: | 280 flushes at 21 per day |
| Foam behavior: | 250 ml after 1 min.; 200 ml after 3 mins.; 150 ml after 10 mins. |
| Storage stability: | no phase separation after 4 weeks at 40° C. or 12 weeks at 23° C. |

Production: as in Example 1

EXAMPLE 8

Cleaning Gel with Foam Booster

| Quantities in | % by weight |
|---|---|
| Polysaccharide (Keltrol RD) | 2.0 |
| $C_{8-10}$ alkyl polyglucoside | 5.4 |
| $C_{12-14}$ FAS (Texapon LS 35) | 5.7 |
| Cocofatty acid diethanolamide | 2.0 |
| Citric acid | 3.5 |
| Perfume oil, citrus note (TTF) 92-4536 | 6.0 |
| Ethanol | 3.0 |
| Semiacetal/isothiazoline combination | 0.15 |
| Dye, water-soluble, blue | <0.01 |
| Water | to 100 |
| Viscosity: | 53,000 mPas |
| pH value: | 3.5 |
| Gel structure/appearance: | cloudy gel |
| Storage stability: | no phase separation after 4 weeks at 40° C. or 12 weeks at 23° C. |

Production: as in Example 1+ addition of fatty acid diethanolamide.

EXAMPLE 9

Cleaning Gel with Increased Lime Dissolving Capacity

| Quantities in | % by weight |
|---|---|
| Polysaccharide (Keltrol T) | 2.8 |
| $C_{8-10}$ alkyl polyglucoside | 5.4 |
| $C_{12-14}$ ether sulfate + 2EO | 8.1 |
| Citric acid | 10.0 |
| Perfume oil, citrus note (TTF) 96-5239 | 4.5 |
| Ethanol | 3.0 |
| Semiacetal/isothiazoline combination | 0.15 |
| Dye, water-soluble, blue/yellow | <0.01 |
| Water | to 100 |
| Viscosity: | 72,000 mPas |
| pH value: | 2.3 |
| Gel structure/appearance: | opaque gel |
| Storage stability: | no phase separation after 4 weeks at 40° C. or 12 weeks at 23° C. |

Production: as in Example 1

EXAMPLE 11

Cleaning Gel Based on Nonionic Surfactant

| Quantities | in % by weight |
|---|---|
| Polysaccharide (Keltrol T) | 2.5 |
| $C_{8-10}$ alkyl polyglucoside | 5.4 |
| $C_{12-18}$ fatty alcohol + 7EO (Dehydol LT 7) | 10.0 |
| Citric acid | 3.0 |
| Perfume oil, citrus note | 5.1 |
| Ethanol | 3.0 |
| Semiacetal/isothiazoline combination | 0.05 |
| Dye, water-soluble blue + yellow | <0.01 |
| Water | to 100 |
| Viscosity: | 100,000 mPas |
| pH value: | 2.8 |
| Gel structure/appearance: | clear transparent gel |
| Storage stability: | no phase separation after 3 weeks at 40° C.<br>no phase separation after 12 weeks at 23° C. |

Production: as in Example 2

COMPARISON EXAMPLES CONTAINING OTHER GEL-FORMING SYSTEMS

A1, A2 sodium-chloride-thickened surfactant system

B1, B2, B3 polyacrylate-based gel

C1 hydroxyethyl cellulose-based gel

Sodium-chloride-thickened Surfactant System

| Quantities in | % by weight | % by weight |
|---|---|---|
| Sodium chloride | 1.0 | 5.0 |
| $C_{12-14}$ fatty alcohol ether sulfate + 2EO | 5.6 | 6.0 |
| Fatty acid amide with betaine structure (Dehyton K) | 3.3 | 3.5 |
| Perfume, citrus | 1.0 | 6.0 |
| Water to | 100 | 100 |
| Viscosity: | 60,000 mPas | 18,000 mPas |
| pH value: | 9.0 | 9.0 |
| Gel structure/appearance: | clear, slightly cloudy | |
| Stability: dilutes heavily on flushing with water. | | |
| Unstable viscosity - flows from the container after introduction. | | |

COMPARISON EXAMPLES B1, B2, B3

Polyacrylate-based Gel

| Quantities in | % by weight | % by weight | % by weight |
|---|---|---|---|
| Polyacrylic acid | | | |
| (Carbopol ® ETD 2690) | 1.0 | — | — |
| (Carbopol ETD 2691) | — | 1.0 | — |
| (Carbopol EZ 2) | — | — | 1.0 |
| $C_{8-10}$ alkyl polyglucoside | 5.4 | 5.4 | 5.4 |
| $C_{12-14}$ fatty alcohol ether sulfate + 2EO | 8.12 | 8.12 | 8.12 |
| Perfume oil, apple note | 6.0 | 6.0 | 6.0 |
| Ethanol | 3.0 | 3.0 | 3.0 |
| Triethanolamine | 1.8 | 2.0 | 2.2 |
| Dye | <0.1 | <0.1 | <0.1 |
| Water | to 100 | to 100 | to 100 |
| Viscosity: | | 200 mPas | |
| pH value: | 7.5 | 8.0 | 8.5 |

-continued

| Quantities in | % by weight | % by weight | % by weight |
|---|---|---|---|
| Gel structure/appearance | cloudy, low-viscosity liquid without gel formation | | |
| Stability: | flows uncontrollably from the container | | |

COMPARISON EXAMPLE C1

Hydroxyethyl Cellulose-based Gel

| Quantities in | % by weight |
|---|---|
| Natrosol 250 HHBR | 2.5 |
| $C_{8-10}$ polyglucoside | 5.4 |
| $C_{12-14}$ fatty alcohol ether sulfate + 2EO | 8.12 |
| Ethanol | 3.0 |
| Perfume oil, apple note | 6.0 |
| Trisodium citrate | 3.0 |
| Dye, preservative | <1.0 |
| Water | to 100 |
| Viscosity: | cannot be determined because the gel formed phase-separates immediately after addition of the perfume |
| pH value: | 7.5 |

What is claimed is:

1. A stable, gel-form, shear-thinning cleaning composition comprising:

(a) 1 to 5 percent by weight of a polysaccharide comprising an xanthan gum or a guar gum;

(b) 3 to 25 percent by weight of a $C_{8-22}$ alkyl polyglycoside; and (c) 2 to 15 percent by weight of a perfume, wherein said composition has a viscosity of 30,000 to 150,000 mPas as measured with a Brookfield RVT rotational viscometer with a Helipath spindle and TA spindle at 1 r.p.m. at 23° C.

2. The composition of claim 1 comprising 1 to 4 percent by weight of said polysaccharide.

3. The composition of claim 2 comprising 1.5 to 3.5 percent by weight of said polysaccharide.

4. The composition of claim 3 comprising 1.8 to 3 percent by weight of said polysaccharide.

5. The composition of claim 1 comprising 4 to 20 percent by weight of said $C_{8-22}$ alkyl polyglycoside.

6. The composition of claim 5 comprising 5 to 15 percent by weight of said $C_{8-22}$ alkyl polyglycoside.

7. The composition of claim 1 comprising 2 to 12 percent by weight of said perfume component.

8. The composition of claim 7 comprising 3 to 8 percent by weight of said perfume component.

9. The composition of claim 1 further comprising air bubbles.

10. The composition of claim 9 wherein said air bubbles have diameters between 0.1 and 20 mm.

11. The composition of claim 10 wherein said air bubbles have diameters between 1 and 15 mm.

12. The composition of claim 9 comprising up to 30 percent by volume of air.

13. The composition of claim 12 comprising 2 to 25 percent by volume of air.

14. The composition of claim 13 comprising 5 to 20 percent by volume of air.

15. The composition of claim 1 further comprising inorganic or organic acids or salts thereof or mixtures thereof.

16. The composition of claim 15 comprising 2 to 5 percent by weight of citric acid, acetic acid or lactic acid.

17. The composition of claim 1 further comprising up to 5 percent by weight of a water-soluble dye.

18. The composition of claim 17 further comprising up to 3 percent by weight of said water-soluble dye.

19. The composition of claim 18 further comprising up to 1 percent by weight of said water-soluble dye.

20. The composition of claim 1 further comprising up to 5 percent by weight of a germ inhibitor selected from the group consisting of isothiazolines, benzoates, salicylic acid, and salicylates.

21. The composition of claim 20 comprising 0.01 to 3 percent by weigh t of said germ inhibitor.

22. The composition of claim 21 comprising 0.01 to 1 percent by weight of said germ inhibitor.

23. The composition of claim 1 further comprising up to 10 percent by weight of a builder or complexing agent.

24. The composition of claim 23 where in said builder or complexing agent comprises a citrate.

25. The composition of claim 24 comprising 0.1 to 8 percent by weight of said builder or complexing agent.

26. The composition of claim 25 comprising 2 to 5 percent by weight of said complexing agent.

27. The composition of claim 1 further comprising up to 5 percent by weight of a lower alcohol solvent.

28. The composition of claim 27 comprising 0.5 to 3 percent by weight of said solvent.

29. The composition of claim 1 further comprising a fatty alcohol ether sulfate, a fatty alcohol sulfate, or mixtures thereof, wherein the weight ratio of the $C_{8-22}$ alkyl polyglycoside to said alcohol ether sulfate or fatty alcohol sulfate is from 50:1 to 1:1.

30. The composition of claim 29 wherein the weight ratio of the $C_{8-22}$ alkyl polyglycoside to said alcohol ether sulfate or fatty alcohol sulfate is from 10:1 to 1.5:1.

31. The composition of claim 30 wherein the weight ratio of the alkyl polyglycoside to said alcohol ether sulfate or fatty alcohol sulfate is from 5:1 to 1.8:1.

32. A process for the production of the cleaning composition of claim 1 comprising:

(a) suspending the polysaccharide and the perfume in a lower monohydric alcohol solvent;

(b) combining the suspension of (a) with water to form an aqueous solution; and (c) slowly adding the alkyl polyglycoside to said aqueous solution, to form the cleaning composition.

33. The process of claim 32 further comprising adding a dye to the water of step (b) prior to combination with the suspension of step (a).

34. The process of claim 32 further comprising applying a reduced pressure to the composition formed in step (c) for from a few minutes to several hours.

35. A system for cleaning a flush toilet comprising a container filled with the cleaning composition of claim 1.

36. The system of claim 35 wherein said cleaning composition can be refilled from a storage container.

37. A process for cleaning a flush toilet comprising suspending the cleaning system of claim 35 in said toilet.

* * * * *